US006353937B1

(12) United States Patent
Martindale

(10) Patent No.: US 6,353,937 B1
(45) Date of Patent: Mar. 12, 2002

(54) METHOD FOR SECURING HAIR ON A PERSON'S HEAD

(76) Inventor: Cheryl Martindale, 3440 Carnation Ct. North, Tallahassee, FL (US) 32303

( * ) Notice: Subject to any disclaimer, the term of this patent is extended or adjusted under 35 U.S.C. 154(b) by 0 days.

(21) Appl. No.: 09/456,120

(22) Filed: Dec. 7, 1999

(51) Int. Cl.[7] ..... A42B 5/00
(52) U.S. Cl. ..... 2/207; 132/200
(58) Field of Search ..... 2/207, 171, 202, 2/204, 206, 174; 132/200, 212

(56) References Cited

U.S. PATENT DOCUMENTS

| | | | | | |
|---|---|---|---|---|---|
| 1,728,138 | A | * | 9/1929 | Robinson | 2/171 |
| 3,260,292 | A | * | 7/1966 | Costello | 2/171 |
| 4,468,818 | A | * | 9/1984 | Flannery | 2/207 |
| 4,492,242 | A | * | 1/1985 | Dalton | 132/53 |
| 5,058,211 | A | * | 10/1991 | Hanks | 2/206 |
| 5,062,157 | A | * | 11/1991 | Muta | 2/171 |
| 5,083,318 | A | * | 1/1992 | Hook | 2/207 |
| 5,085,917 | A | * | 2/1992 | Hodnett, II | 428/173 |
| 5,336,543 | A | * | 8/1994 | Pyle | 428/78 |
| 5,365,613 | A | | 11/1994 | Henegan | 2/174 |
| 5,490,528 | A | | 2/1996 | Day | 132/200 |
| 5,685,016 | A | * | 11/1997 | Douglas | 2/171 |
| 5,708,982 | A | | 1/1998 | Armani | 2/171 |
| 5,906,006 | A | * | 5/1999 | Castro, Jr. | 2/207 |

* cited by examiner

*Primary Examiner*—Bibhu Mohanty
*Assistant Examiner*—Katherine Moran
(74) *Attorney, Agent, or Firm*—Peter Loffler

(57) ABSTRACT

A method that allows a person to place a moisture absorbing towel onto her head uses a triangular towel that has its sides selvaged or that has its sides folded at least once onto the body portion and sewn thereto. The long side of the towel is positioned onto the front of the person's head and the two corners at the ends of this side are brought around to the back of the head and the corners are attached to each other. The remaining corner is brought over the top of the head and attached to the other two corners or tucked underneath the two corners.

5 Claims, 4 Drawing Sheets

METHOD FOR SECURING HAIR ON A PERSON'S HEAD

BACKGROUND OF THE INVENTION

1. Field of the Invention

The present invention relates to a method that effectively positions a triangular towel about a person's head thereby securing the person's hair.

2. Background of the Prior Art

Many individuals, especially those with relatively long hair, appreciate the difficulty that is encountered with their hair after a shower. Either the hair is left to be and drips all over the floor and the counter, creating a mess, or a standard towel is somehow placed onto the person's head in an attempt to secure the hair. While many creative towel securing positions have been attempted, these positions result in a loose fit of the towel wherein the towel falls off with minor movement of the individual. After a couple of attempts at replacing the towel onto the head, the individual becomes frustrated and leaves the hair to be. Alternately, the towel is positioned onto the head and held in place with one of the individual's hands. This method restricts the abilities of the person to put on makeup, brush her teeth, etc. A third method of securing a towel to a person's head in order to secure the hair thereon, is to use clips and safety pins to hold the towel in place. This method is time-consuming and frustrating to the individual and proves marginal at best in its intended results.

Therefore, there is a need in the art for a method of attaching a towel to a person's head in order to secure the person's hair that overcomes the above-stated problems in the art. Such a method must be relatively easy to implement and must allow both hands of the person to remain free to perform other tasks. Such a method must hold the towel on the head relatively securely even if the person engages in substantial movement. Such a method must not rely on complex or unusual tools and must use straightforward implements.

SUMMARY OF THE INVENTION

The method for securing hair on a person's head of the present invention addresses the aforementioned needs in the art. The method provides a relatively simple solution for placing a towel onto the person's hair and securing the towel thereto. The method, which is relatively straightforward to practice and does not require unusual equipment to implement, holds the towel in place even with substantial movement by the person.

The method for securing hair on a person's head of the present invention comprises the steps of providing a towel that is generally isosceles triangular shaped with the base side being greater in length than the two equal sides and being greater in length than the height, the towel having a first side, a second side, a third (base) side, a first corner at the joinder of the first side and the second side, a second corner, at the joinder of the second side and the third side, a third corner at the joinder of the third side and the first side, and a body portion. Each of the three sides can be selvaged or can be folded onto the body portion at least one time and thereafter sewn to the body portion to create a selvaged finish. Thereafter, the third side of the towel is placed against the front portion of the person's head. The second corner is brought around the right side of the head and is positioned proximate the back of the head while the third corner is brought around the left side of the head and is positioned proximate the back of the head. The second corner and the third corner are attached to one another, either by tying the two corners together or by using any appropriate mechanical implement—clip, bobby pin. stretchable band, rope, lace, snap, buckle, cooperating hook and loop material, safety pin, etc.,—proximate the second corner and the third corner. The first corner is brought over the top of the head and is positioned proximate the back of the head. The first corner is attached to the second corner and to the third corner. This attachment can be accomplished by tying the first corner to the other two corners, using the same mechanical implement that is used to attached the other two corners, or tucking the first corner underneath the attached second corner and third corner.

BRIEF DESCRIPTION OF THE DRAWINGS

Similar reference numerals refer to similar parts throughout the several views of the drawings.

DESCRIPTION OF THE PREFERRED EMBODIMENT

Figure 1:
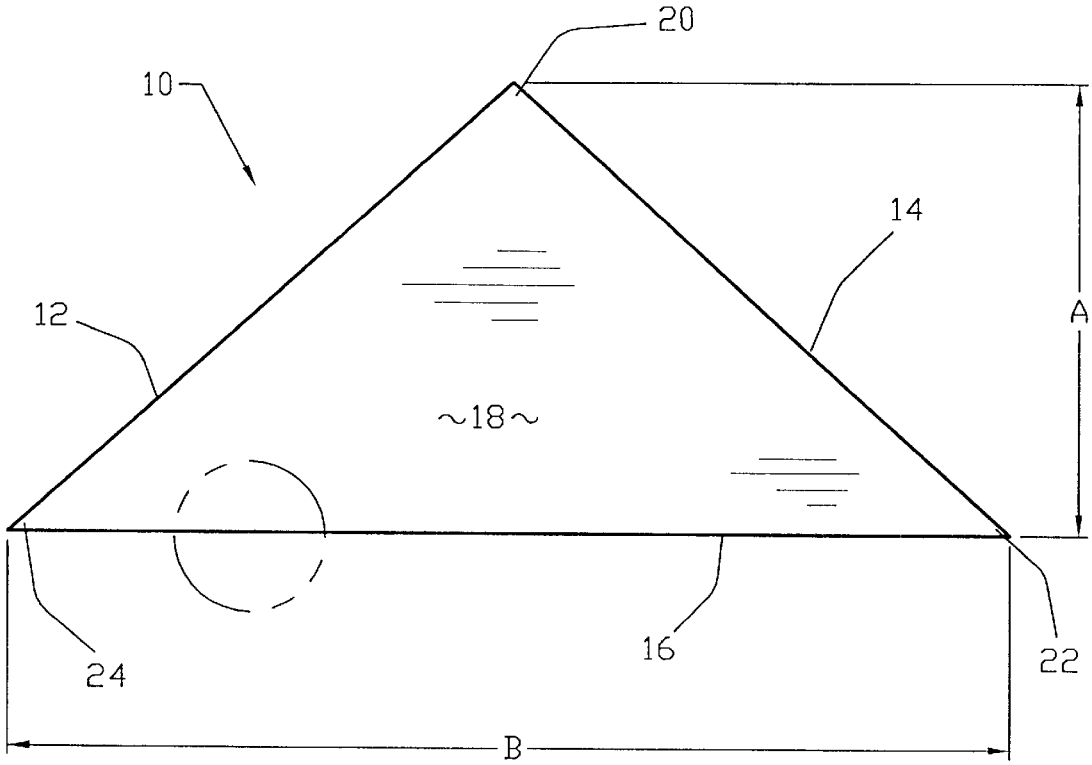
FIG. 1 is a plan view of the towel that is used with the method for securing hair on a person's head of the present invention.
Figure 2:
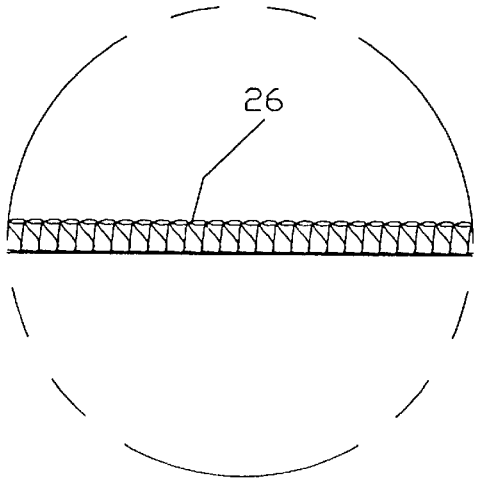
FIG. 2 is a close-up view of a portion of the selvaged third side of the towel.
Figure 4:
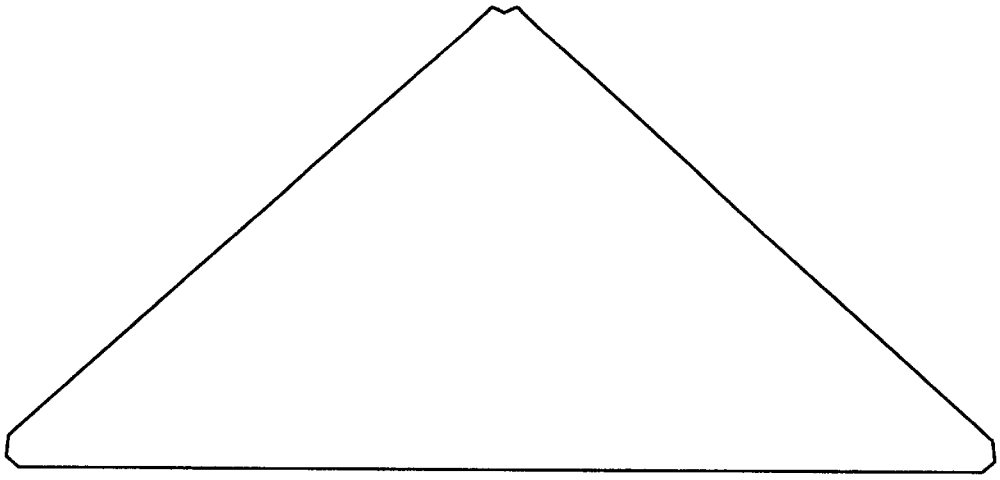
FIG. 4 is a plan view of the towel of FIG. 3 after the selvage operation is complete.
Figure 3:
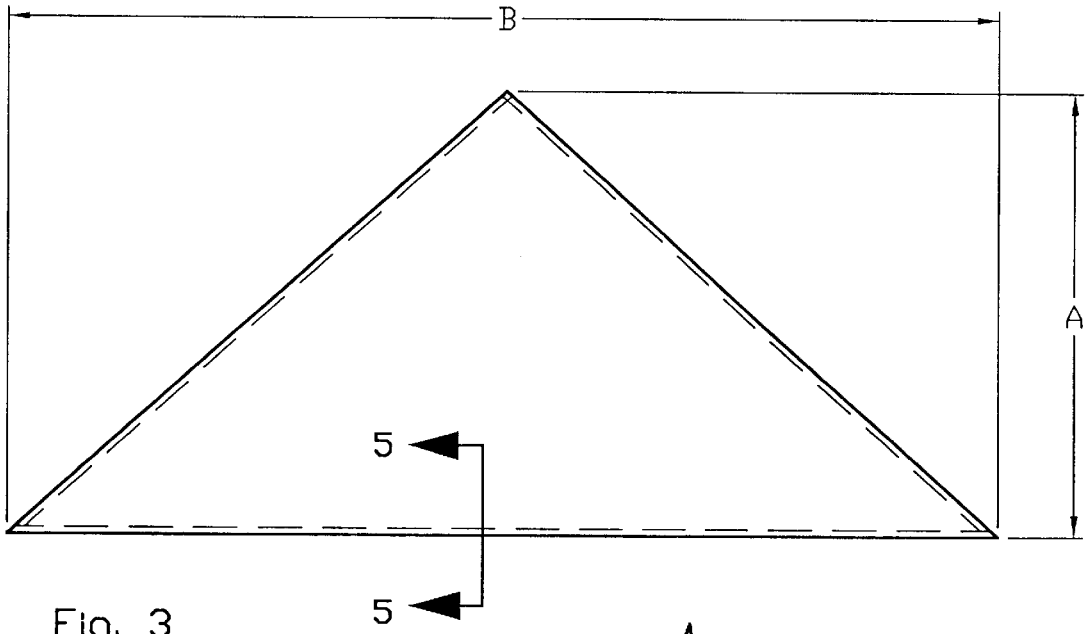
FIG. 3 is a plan view of the towel illustrating an alternate method of selvaging the three sides of the towel.
Figure 5:
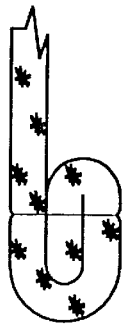
FIG. 5 is a sectioned view of the towel taken along line 5—5 in FIG. 3.
Figure 6:
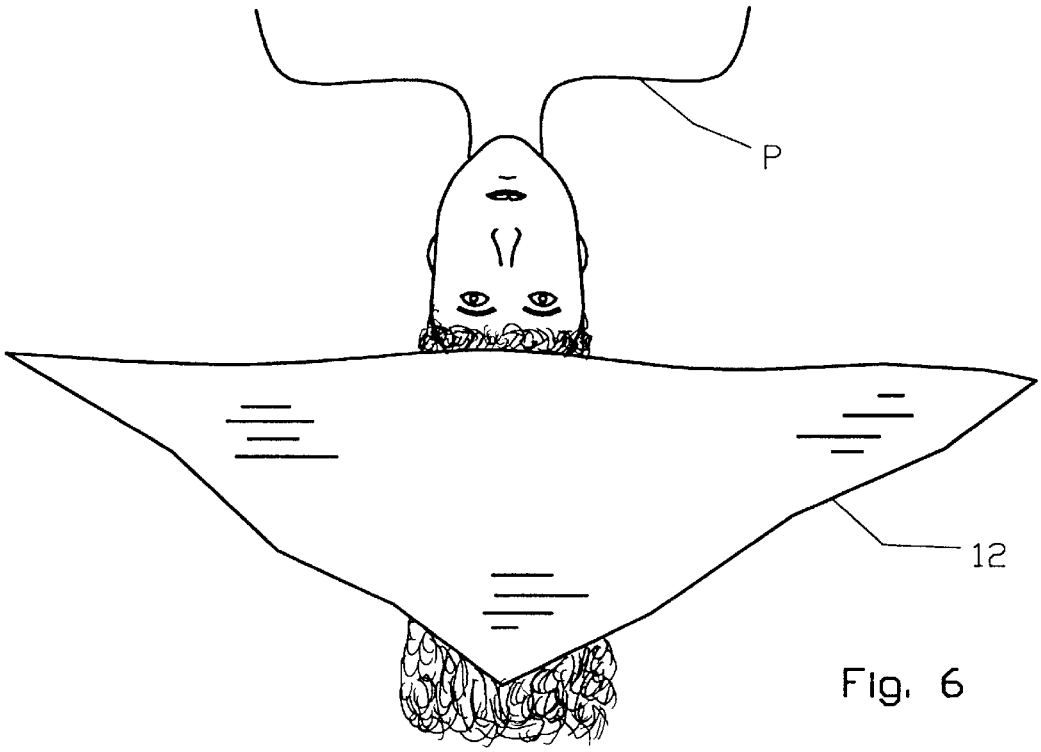
FIG. 6 illustrates the initial position for placement of the towel with respect to the person.
Figure 7:
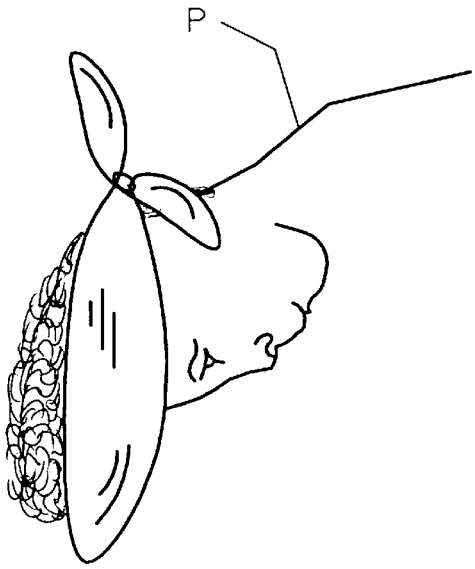
FIGS. 7 and 8 illustrate two of the final positions for placement of the towel with respect to the person.
Figure 8:
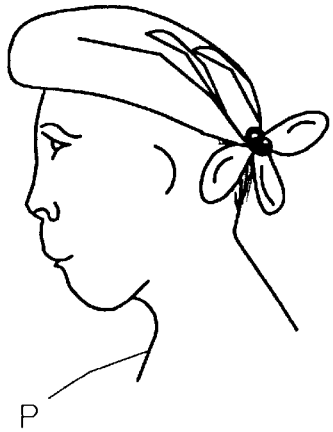
Figure 9:
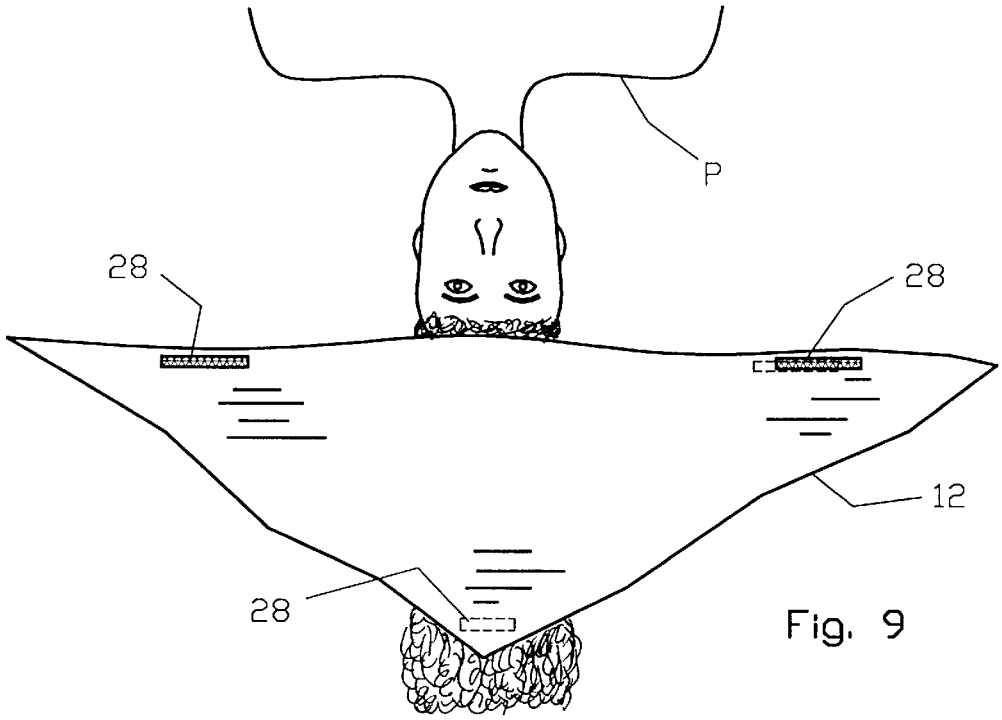
FIGS. 9–11 illustrate an alternate method of securement of the towel to a person.
Figure 10:
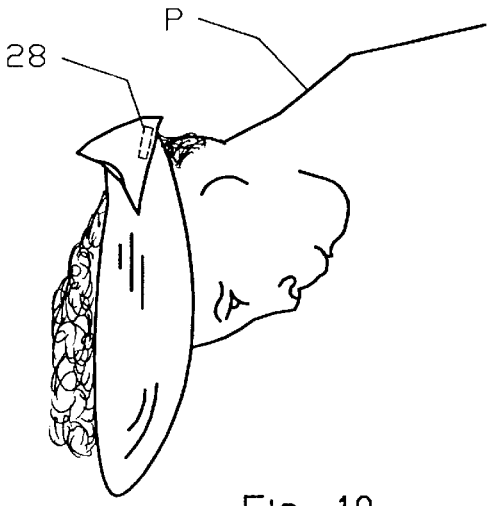
Figure 11:
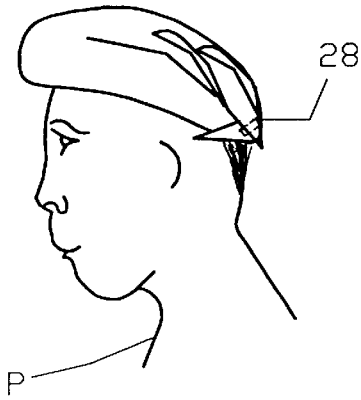

Referring now to the drawings, it is seen that the method for securing hair on a persons head comprises the step of providing a generally triangular-shaped towel 10. The towel 10, which is single ply and which is made from any appropriate moisture absorbing material such as cotton and terry cloth, has a first side 12, a second side 14, a third side 16, and a body portion 18. A first corner 20 is located at the joinder of the first side 12 and the second side 14, a second corner 22 is located at the joinder of the second side 14 and the third side 16, and a third corner 24 is located that the joinder of the third side 16 and the first side 12. The towel has an isosceles shape with the third side 16 being longer than the first side 12 and the second side 14. Additionally, the third side 16 has a length B that is greater than the height A of the triangle. Ideally, the length B of the third side 16 is between about 24 inches and about 70 inches while the height A is between about 13 inches and about 33 inches depending on the size of the person using the towel 10. As seen, in FIG. 2, the each of the three sides 12, 14, and 16 are selvaged in any appropriate fashion such as stitching the sides 12, 14, and 16, or by placing an appropriate strip 26 along each of the three sides 12, 14, and 16, and sewing the strip 26 to the towel 10. Alternately, the three sides 12, 14, and 16 can be selvaged by folding the first side 12 onto the body portion 18 at least one time and sewing this folded portion to the body member 18, then folding the second side 14 onto the body portion 18 at least one time (the same number of folds as with the first side 12) and sewing this folded portion onto the body portion 18, and then folding the third side 16 onto the body portion 18 at least one time (the same number of folds as with the first side 12 and the second side 14) and sewing this folded portion onto the body portion 18. This method of selvaging gives the three sides 12, 14, and 16 a relatively sturdy structure allowing for ease of handling of the towel. Nevertheless, the width of each folded portion is relatively thin so that the towel 10 remains relatively manipulatable.

The towel 10 is positioned so that the third side 16 is placed against the front of the head of the person P. The second corner 22 is brought around the right side of the person's head H and positioned proximate the back of the head while the third corner 24 is brought around the left side of the person's head H and positioned proximate the back of the head. The second corner 22 and the third corner 24 are attached to one another. This attachment can be accomplished by tying the two corners 22 and 24 together or by providing an appropriate mechanical implement 28 to attach the two corners 22 and 24 together. At this point, the hair, can be placed into the body portion 18 of the towel 10 which forms a basket to hold the hair. Alternately, the first corner 20 can be brought over top the person's head H and attached to the second corner 22 and the third corner 24. This attachment can be accomplished by tying the first corner 20 to the second corner 22 and to the third corner 24. Alternately, if a mechanical implement 28 is used to attach the second corner 22 and the third corner 24, this mechanical implement 28 can also be used to attach the first corner 20 to the other two corners 22 and 24. Alternately, the first corner 20 can be tucked underneath the attached second corner 22 and third corner 24. The person P is now free to walk about with her hair secured.

While the invention has been particularly shown and described with reference to an embodiment thereof, it will be appreciated by those skilled in the art that various changes in form and detail may be made without departing from the spirit and scope of the invention.

I claim:

1. A method for securing hair on a person's head, the head having a front, a left side, a right side, a top, and a back, the method comprising the steps of;

providing a generally triangle-shaped towel, the towel having a first side, a second side, a third side, a first corner at the joinder of the first side and the second side, a second corner, at the joinder of the second side and the third side, a third corner at the joinder of the third side and the first side, and a body portion wherein the height is between about 13 inches and about 33 inches and the length is between about 24 inches and about 70 inches;

folding the first side onto the body portion and sewing the first side to the body portion;

folding the second side onto the body portion and sewing the first side to the body portion;

folding the third side onto the body portion and sewing the first side to the body portion;

placing the third side of the towel against the front portion of the head;

bringing the second corner around the right side and positioning the second corner proximate the back;

bringing the third corner around the left side and positioning the third corner proximate the back;

tying the second corner to the third corner;

bringing the first corner over the top and positioning the first corner proximate the back; and attaching the first corner with the second corner and the third corner.

2. The method as in claim 1 wherein the third side has a length and wherein a height is established between the first corner and the third side, the height being less than the length.

3. The method as in claim 1 wherein the first side has a first length and the second side has a second length that is generally equal to the first length.

4. The method as in claim 3 wherein the third side has a third length that is greater than the first length.

5. The method as in claim 1 wherein the first corner is tied to the second corner and to the third corner.

* * * * *